US009073729B2

(12) United States Patent
Hernandez et al.

(10) Patent No.: US 9,073,729 B2
(45) Date of Patent: Jul. 7, 2015

(54) PAPERBOARD CORE SPINDLE SUPPORT FOR YARN PACKAGES

(75) Inventors: Ismael Antonio Hernandez, Florence, SC (US); David L. Rykard, Hartsville, SC (US); John F. Whitehead, Hartsville, SC (US)

(73) Assignee: Sonoco Development, Inc., Hartsville, SC (US)

( * ) Notice: Subject to any disclaimer, the term of this patent is extended or adjusted under 35 U.S.C. 154(b) by 544 days.

(21) Appl. No.: 13/368,865

(22) Filed: Feb. 8, 2012

(65) Prior Publication Data

US 2013/0200203 A1 Aug. 8, 2013

(51) Int. Cl.

| | |
|---|---|
| ***B65H 75/24*** | (2006.01) |
| ***B65H 75/18*** | (2006.01) |
| ***B65H 75/30*** | (2006.01) |
| ***D01H 7/16*** | (2006.01) |

(52) U.S. Cl.

CPC ..... *B65H 75/185* (2013.01); *B65H 75/247* (2013.01); *B65H 75/245* (2013.01); *B65H 75/30* (2013.01); *D01H 7/16* (2013.01); *B65H 2701/5112* (2013.01)

(58) Field of Classification Search

CPC .. B65H 75/245; B65H 75/248; B65H 75/185; B65H 75/30; B65H 75/246; B65H 75/247; D01H 7/16

USPC ..... 242/571, 571.3, 571.4, 571.5, 571.8, 242/597, 597.1, 597.3, 597.6, 597.8

See application file for complete search history.

(56) References Cited

U.S. PATENT DOCUMENTS

| | | | | | |
|---|---|---|---|---|---|
| 734,922 | A | * | 7/1903 | Metcalf | 242/571.7 |
| 2,024,584 | A | * | 12/1935 | Kuwada | 242/571.5 |
| 2,616,633 | A | * | 11/1952 | Reynolds | 242/571.3 |
| 2,835,517 | A | * | 5/1958 | Beerli | 403/328 |
| 2,973,161 | A | * | 2/1961 | Harmon | 242/130 |
| 3,077,070 | A | | 2/1963 | Smith et al. | |
| 3,327,466 | A | * | 6/1967 | Hare | 57/130 |
| 3,360,208 | A | * | 12/1967 | Winkler | 242/571.4 |

(Continued)

FOREIGN PATENT DOCUMENTS

| | | | |
|---|---|---|---|
| WO | WO 9902442 | A1 * | 1/1999 |
| WO | WO 2008/052371 | A1 | 5/2008 |
| WO | WO 2008/152673 | A1 | 12/2008 |

OTHER PUBLICATIONS

"Drawtwisting and Draw-Winding Machines"; Plants Equipment and Machines for the Production of Synthetic Yarns and Fibers; pp. 417-428.

(Continued)

*Primary Examiner* — William E Dondero

(74) *Attorney, Agent, or Firm* — Alston & Bird LLP

(57) ABSTRACT

A support for mounting a paperboard yarn core on a spindle assembly includes a proximal-end support member for supporting a proximal end of the core and engaging it in a substantially non-slip manner, and a distal-end support member for supporting a distal end of the core. The proximal-end support member is configured to be mounted on a hub of the spindle assembly. The support members locate the core substantially coaxially with respect to a rotational axis of the spindle assembly. The proximal-end support member is configured to automatically prevent or minimize slippage of the core with respect to the support member both in acceleration and deceleration or braking of the spindle assembly.

4 Claims, 6 Drawing Sheets

(56) References Cited

U.S. PATENT DOCUMENTS

| | | | | | |
|---|---|---|---|---|---|
| 3,368,767 | A | * | 2/1968 | Schmidt | 242/597.6 |
| 3,655,141 | A | | 4/1972 | Warthen | |
| 3,695,561 | A | | 10/1972 | Pitts | |
| 3,923,261 | A | * | 12/1975 | Isoard et al. | 242/571.6 |
| 3,946,962 | A | * | 3/1976 | Deletzke, Jr. | 242/571.4 |
| 4,496,114 | A | * | 1/1985 | Kataoka | 242/571.7 |
| 4,767,077 | A | * | 8/1988 | Kataoka | 242/571.7 |
| 5,297,750 | A | * | 3/1994 | Hunt | 242/422.4 |
| 6,513,751 | B2 | * | 2/2003 | Michel | 242/571.1 |
| 2002/0121570 | A1 | * | 9/2002 | Yermal | 242/530.3 |
| 2007/0278342 | A1 | * | 12/2007 | Harkins | 242/571 |

OTHER PUBLICATIONS

International Search Report and Written Opinion for Application No. PCT/US2013/020761 dated Apr. 12, 2013.

* cited by examiner

PAPERBOARD CORE SPINDLE SUPPORT FOR YARN PACKAGES

BACKGROUND OF THE INVENTION

The present disclosure relates to yarn tubes or cores upon which yarns are wound to form yarn packages.

In the production of yarn it is frequently necessary to wind a yarn about a yarn tube to form a yarn package that can then be transported to another piece of equipment or another location at which the yarn is then unwound from the yarn package and processed in some manner. In certain segments of the yarn manufacturing industry it has been the conventional practice to use metal yarn tubes. A metal yarn tube is configured to be mounted on a drive spindle assembly that rotates the yarn tube for winding yarn onto the yarn tube to form a yarn package, or for paying yarn out from a yarn package already wound on the yarn tube.

A typical spindle assembly includes a hub that is rotatably driven by a motor and drive arrangement so as to rotate about a rotational axis, and an elongate spindle rigidly affixed to the hub and coaxial therewith. The spindle has a length that is about three-quarters or more of the length of the standard metal yarn tube. Thus, the spindle is designed to extend up within the interior of the metal yarn tube and engage a fitting disposed within the yarn tube closer to the distal end than to the proximal end of the tube, so that the yarn tube is radially centered with respect to the spindle assembly both at its proximal end that engages the hub and at a location proximate the distal end.

At one time the typical practice was to use such metal yarn tubes wholly within a single facility, and this enabled the relatively costly metal yarn tubes to be recycled for use many times, with relative ease because of the short distances the tubes had to be transported between different processes at different locations within the same facility. More recently, however, the industry has changed such that it is often necessary to ship yarn packages from one facility to another, sometimes at great distances such as from one country to another. The metal yarn tubes tend not to be returned to the point of origin in these instances, which substantially increases the yarn winder's cost of producing the yarn packages because the winder does not receive the benefit of recycling the already used yarn tubes.

The present disclosure relates to an adapter or support that enables a wound paperboard yarn core to be mounted on the spindle assembly.

BRIEF SUMMARY OF THE DISCLOSURE

In accordance with one embodiment of the invention, a support is provided for a hollow cylindrical paperboard yarn core and for engagement with a cantilevered drive spindle assembly, so that the core can be mounted on the spindle assembly. The spindle assembly has a hub and an elongate rod-shaped spindle rigidly affixed to the hub in cantilever fashion, the hub defining exterior drive surfaces, the spindle being of smaller diameter than the drive surfaces. The support comprises a proximal-end support member for supporting a proximal end of the core and engaging it in a substantially non-slip manner, and a distal-end support member for supporting a distal end of the core. The support members locate the core substantially coaxially with respect to the rotational axis of the spindle assembly.

In one embodiment as described herein, the proximal-end support member is configured to be mounted on the hub, and thus the proximal-end support member defines a through-passage for receiving the spindle therethrough, and it has interior mating surfaces configured to mate with the drive surfaces of the hub so that the proximal-end support member is constrained to rotate with the hub. The proximal-end support member is configured to be removably received into the proximal end of the paperboard core so as to locate the proximal end of the core coaxially with respect to the rotational axis of the spindle assembly. The proximal-end support member comprises core-engaging elements for engaging a cylindrical inner surface of the core so as to cause the core to rotate with the proximal-end support member, and further comprises urging elements operable to urge the core-engaging elements radially outwardly into engagement with the inner surface of the core.

The distal-end support member is configured to be removably inserted into the distal end of the core, and has a core-engaging portion configured to engage the interior surface of the core near the distal end thereof and a spindle-engaging portion rigidly affixed to the core-engaging portion. The spindle-engaging portion defines a bore configured to receive a distal end of the spindle so as to orient the distal-end support member coaxially with respect to the rotational axis. The core-engaging portion of the distal-end support member in turn locates the distal end of the core coaxially with respect to the rotational axis.

In one embodiment, the urging elements include resilient biasing members arranged to apply a radially outward force on each of the core-engaging elements.

The core-engaging elements can comprise rollers.

The proximal-end support member can include a base defining the through-passage for the spindle, and a retainer sleeved over the base and rotatable relative thereto, the retainer capturing the rollers between the retainer and the base in a manner allowing each roller to move radially to a limited radial extent and to move circumferentially to a limited circumferential extent. The biasing members bias the rollers to a radially outward extreme of the limited radial extent in the absence of any radially inward force sufficient to overcome the radially outward force exerted by the biasing members.

In one embodiment, the base defines a wedge surface corresponding to each roller, and each roller is captive between the retainer and the corresponding wedge surface. The wedge surfaces are configured such that any tangential movement of the rollers away from a neutral position thereof with respect to the corresponding wedge surfaces causes the rollers to be moved radially outwardly relative to the neutral position.

In one embodiment, the retainer defines a window for each roller, each window having a circumferential width that becomes narrower in a radially outward direction and reaches a minimum width, each roller having a diameter larger than said minimum width. This allows the rollers to partly protrude out from the windows to engage the ID of the core, but the rollers are prevented from escaping through the windows.

The biasing members can comprise sheet-metal springs.

BRIEF DESCRIPTION OF THE SEVERAL VIEWS OF THE DRAWING(S)

Having thus described the disclosure in general terms, reference will now be made to the accompanying drawings, which are not necessarily drawn to scale, and wherein:

DETAILED DESCRIPTION OF THE DRAWINGS

The present invention now will be described more fully hereinafter with reference to the accompanying drawings in which some but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 3:
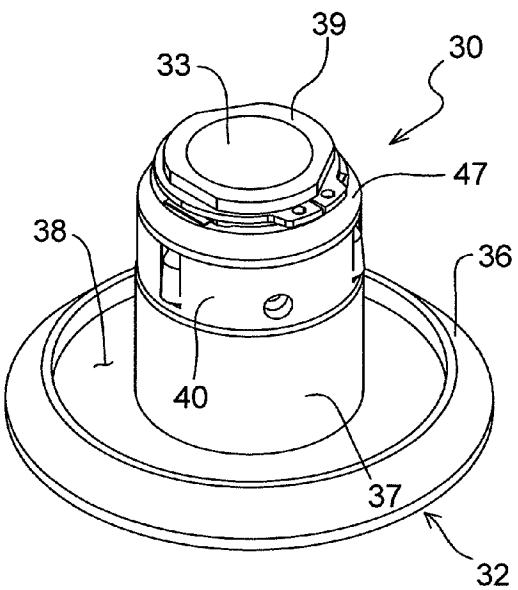
FIG. 3 is an isometric view of the proximal-end support member of the support in accordance with an embodiment of the invention.
Figure 2:
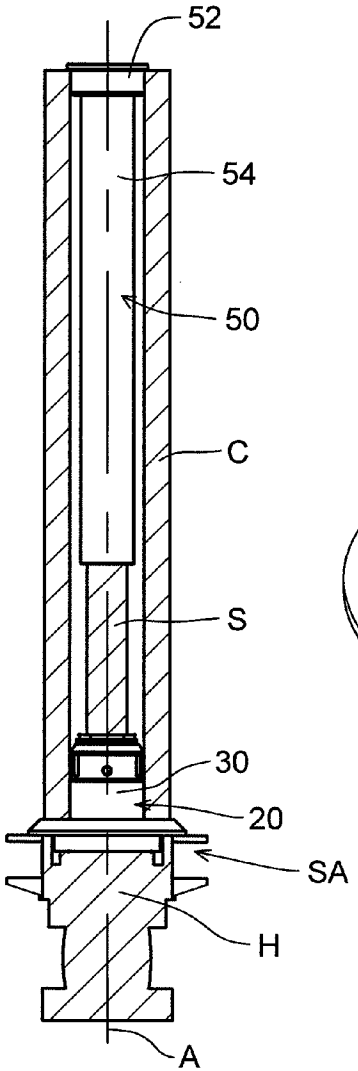
FIG. 2 is a view similar to FIG. 1, but showing only the spindle and core in cross-section, the support being shown in elevation.
Figure 1:
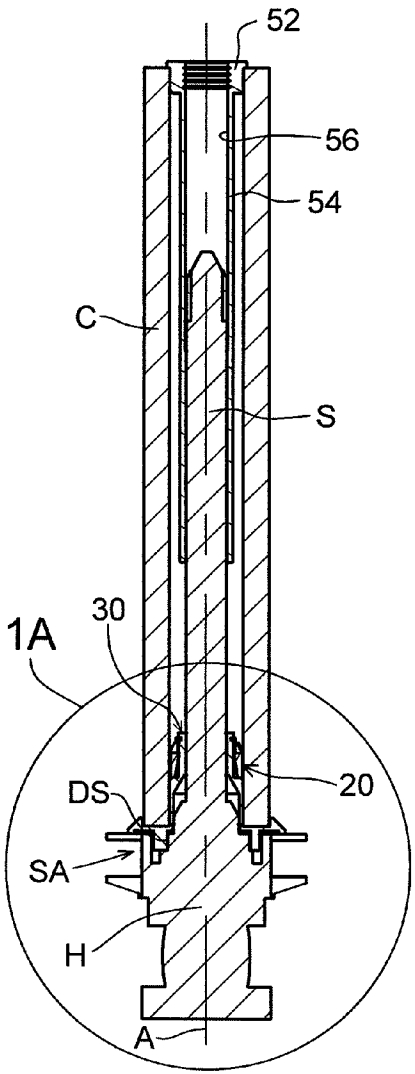
FIG. 1 is a cross-sectional view of a paperboard core mounted on a spindle assembly via a support in accordance with an embodiment of the invention.

A support 20 for allowing a paperboard yarn core C to be mounted on a cantilevered drive spindle assembly SA is depicted in FIGS. 1 and 2, and components of the support 20 are depicted in FIGS. 3 through 11. The spindle assembly SA is a standard type of spindle assembly commonly used with metal yarn tubes. The spindle assembly includes a hub H that is rotatably driven by a suitable motor and drive arrangement (not shown) so as to rotate about a rotational axis A, and an elongate spindle S rigidly affixed to the hub and coaxial therewith. The spindle has a length that is about three-quarters or more of the length of the standard metal yarn tubes that are commonly used with such spindle assemblies. Thus, the spindle is designed to extend up within the interior of the metal yarn tube and engage a fitting disposed within the yarn tube closer to the distal end than to the proximal end of the tube, so that the yarn tube is radially centered with respect to the spindle assembly both at its proximal end (which engages the hub H) and at a location proximate the distal end.

With initial reference to FIGS. 1 and 2, the support 20 functions essentially as an adapter to enable a paperboard yarn core C to be mounted on the spindle assembly SA. The support 20 comprises a proximal-end support member 30 that is mounted on the hub H of the spindle assembly and engages the proximal end of the core C, and a distal-end support member 50 that is removably insertable into the distal end of the core and that engages the spindle S. As described below, the proximal-end support member 30 is configured to operate as a clutch mechanism that automatically tends to prevent slippage of the core relative to the member 30.

With reference to FIGS. 3 through 7, the proximal-end support member 30 includes a base 32 that defines a through-passage 33 so that the spindle S of the spindle assembly can be received through the passage 33. The base 32 further includes a downwardly projecting portion that defines a receptacle 34 in its lower side for receiving an upwardly projecting portion of the hub H of the spindle assembly. The receptacle 34 defines interior mating surfaces 35 (indicated as flats in the illustrated embodiment) that mate with corresponding exterior drive surfaces DS on the hub portion (e.g., the drive surfaces can also be flats) so that the base 32 is thereby constrained to rotate together with the hub H. Three uniformly, circumferentially spaced mating surfaces 35 are shown, but as will be appreciated, other numbers of mating surfaces could be used instead.

Figure 1A:
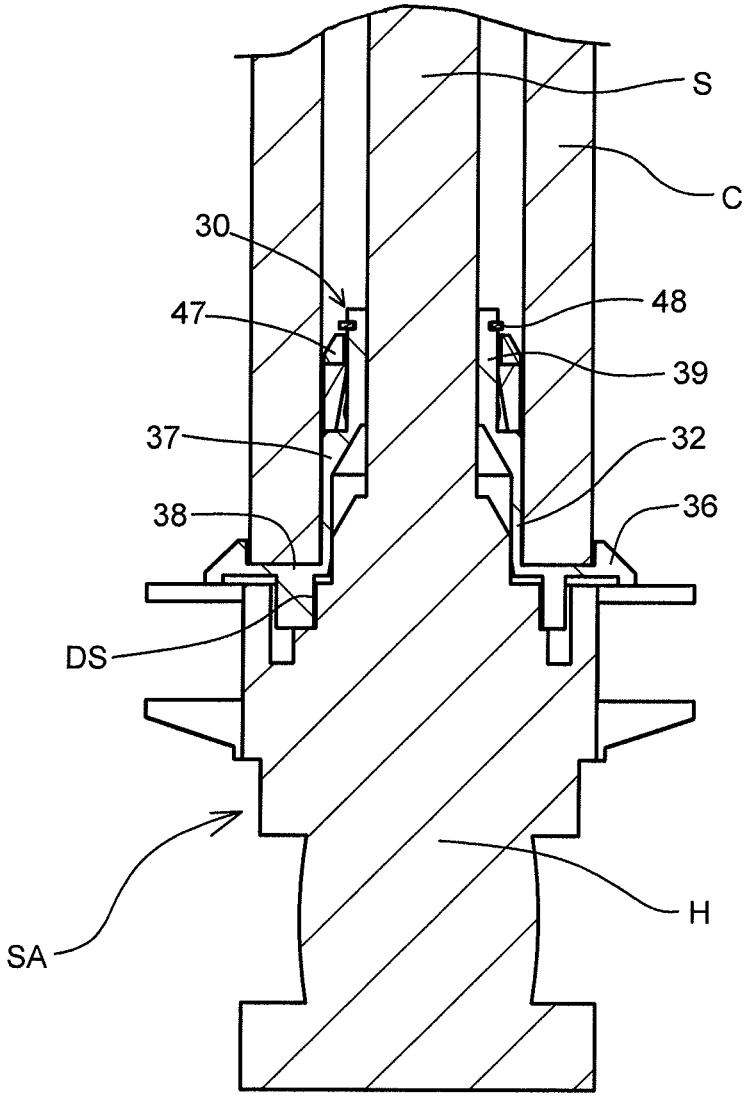
FIG. 1A is an enlarged portion of FIG. 1 as indicated by the circle 1A in FIG. 1.

The base 32 defines an outer skirt 36 having a sloped or generally conical upper surface that acts as a guide surface for yarn being wound onto the paperboard core. The skirt can assume any of various configurations to accommodate different winding spindles. The base further defines a generally cylindrical portion 37 extending upwardly from a transverse wall 38 that connects the skirt 36 to the cylindrical portion 37. The OD of the cylindrical portion 37 is sized to fit closely within the ID of the core C. The skirt 36 includes an ID sized to closely receive the OD of the core C, as best seen in FIG. 1A. Thus, between the cylindrical portion 37, the skirt 36 and the wall 38, a recess is defined for receiving the proximal end of the core C. The base 32 also includes a further generally cylindrical portion 39 that extends upwardly from and constitutes generally a continuation of the cylindrical portion 37 but that is of smaller OD than the portion 37. The base 32 further defines apertures 42 for set screws (not shown). The set screws engage the spindle S so as to secure the proximal-end support member 30 to the spindle.

With primary reference to FIGS. 7 through 10, the proximal-end support member 30 further comprises a retainer 40 that is generally ring-shaped and defines an ID sized to fit closely about the OD of the cylindrical portion 39 of the base 32 but to allow the retainer 40 to rotate relative to the base 32. The retainer defines a plurality of circumferentially spaced clearance holes 41 each for allowing one of the set screws to pass through and engage the aperture 42 in the base. Alternatively, if the apertures 42 for the set screws are located in the lower portion 37 of the base, then the clearance holes 41 are unnecessary.

Figure 4:
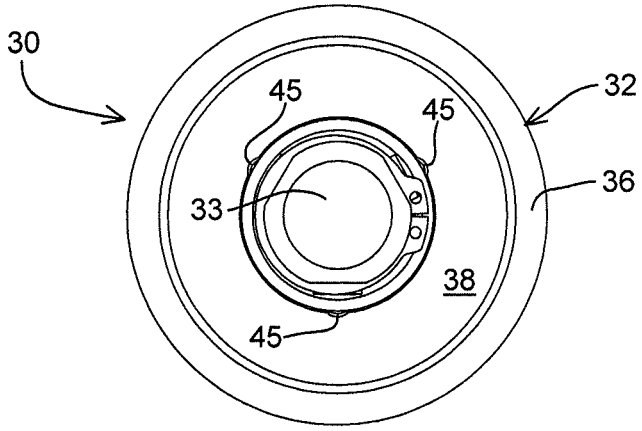
FIG. 4 is a top view of the proximal-end support member.
Figure 5:
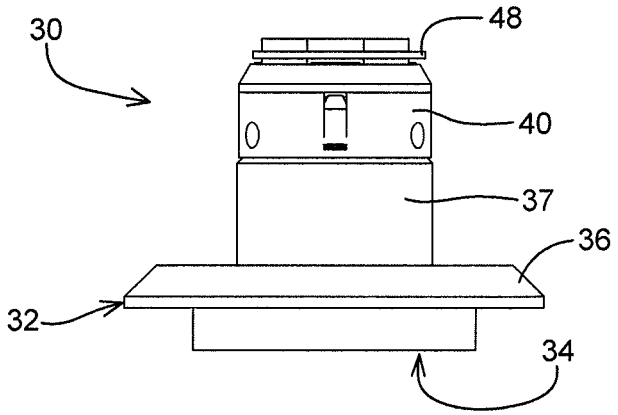
FIG. 5 is a side view of the proximal-end support member.
Figure 6:
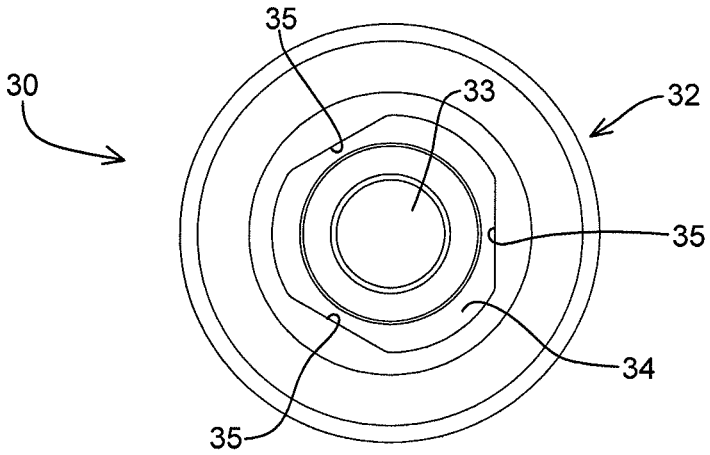
FIG. 6 is a bottom view of the proximal-end support member.
Figure 7:
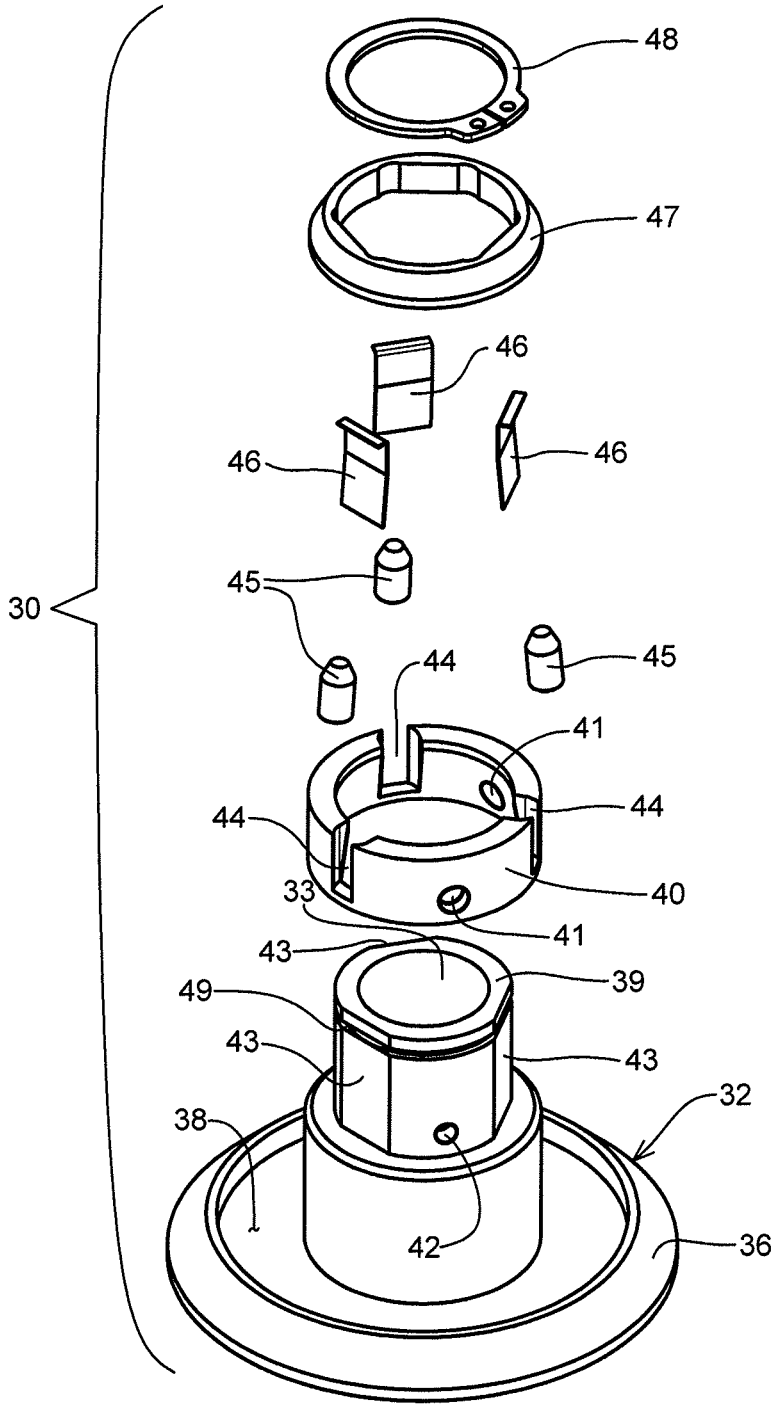
FIG. 7 is an exploded view of the proximal-end support member.
Figure 10:
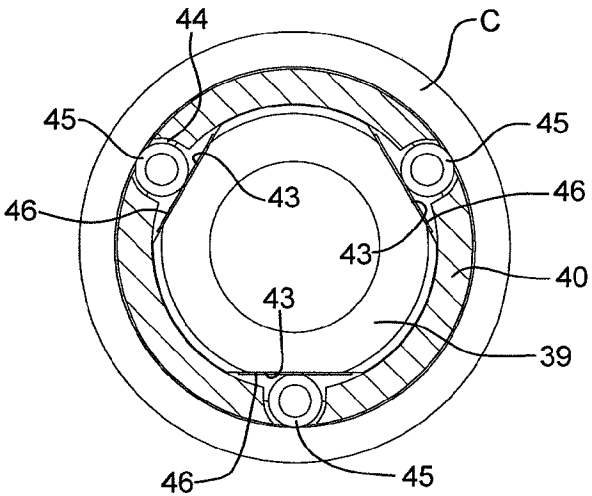
FIG. 10 is a cross-sectional view along line 10-10 in FIG. 9.
Figure 8:
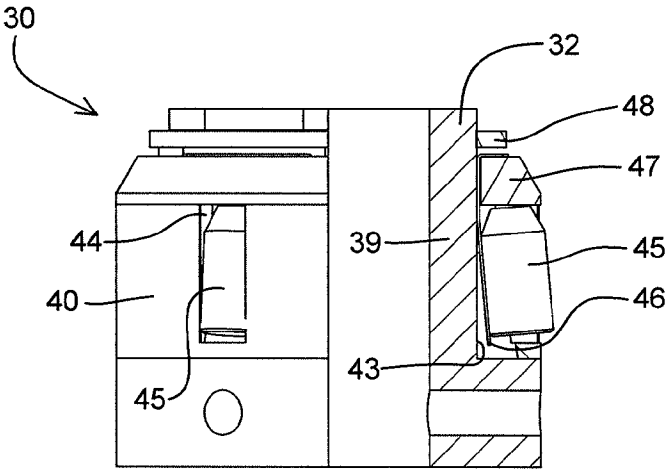
FIG. 8 is a side view, partly in section, of the proximal-end support member.

The generally cylindrical portion 39 of the base 32 is not fully cylindrical, but rather has a plurality of (three, in the illustrated embodiment, although a different number of them is possible) wedge surfaces 43 circumferentially spaced apart about the circumference of the portion 39. As shown, the wedge surfaces can be flat or planar surfaces, although that is not essential. The wedge surfaces 43 lie at a smaller radius than that of the ID of the retainer 40, and hence there is a space between the ID of the retainer and each wedge surface. The retainer 40 defines a number (i.e., the same number as there are wedge surfaces) of cutouts or windows 44. As best seen in FIG. 10, each window 44 converges (i.e., its circumferential width becomes narrower) in the radially outward direction. Each window accommodates a core-engaging element 45 having a circumferential width that exceeds the smallest circumferential width of the window at its radially outer side, so that the window allows part of the core-engaging element to project radially farther out than the OD of the retainer 40 (as best seen in FIGS. 4 and 8), but prevents the core-engaging element from completely passing through the window. In the illustrated embodiment, the core-engaging elements comprise rollers of generally cylindrical configuration.

Figure 9:
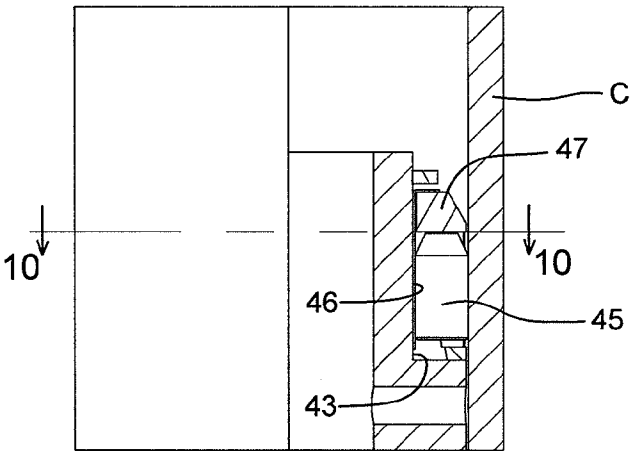
FIG. 9 is a view similar to FIG. 8, but with the paperboard core engaging the proximal-end support member.

Interposed between each core-engaging element 45 and the wedge surface 43 is an urging element 46 whose function is to urge or bias the core-engaging element radially outwardly into the position shown in FIG. 8, where the core-engaging element is at the farthest-outward radial position allowable by the configuration of the window 44 in the retainer 40. In the illustrated embodiment, the urging elements 46 are springs, and particularly sheet metal springs. Each sheet metal spring has an angled configuration defined by two straight portions that form an obtuse angle (e.g., about 170°) between them. The upper straight portion lies against the wedge surface 43 and the lower straight portion angles downwardly and radially outwardly so as to urge the core-engaging element 45 into a canted orientation as seen in FIG. 8, wherein the lower part of the core-engaging element is the part that extends farthest in the radially outward direction. As will be appreciated, it is possible to exert a radially inward force on the core-engaging element so as to overcome the spring force of the urging element 46 and thereby move the core-engaging element inward until the lower straight portion of the urging element 46 abuts the wedge surface 43 (FIG. 9).

The proximal-end support member 30 further comprises a spring retainer 47. The spring retainer is a ring-shaped member having an ID sized larger than the OD of the cylindrical portion 39 of the base 32 by an amount that accommodates the thickness of the urging elements 46. The spring retainer is sleeved over the cylindrical portion 39, above the retainer 40. The urging elements 46 thus are clamped or captured between the spring retainer 47 and the cylindrical portion 39. The uppermost ends of the urging elements 46 can be bent in an "L" shape to form radially outwardly extending leg portions that sit atop the upper surface of the spring retainer 47 so as to prevent the urging elements from shifting axially downward. A split snap ring 48 is also sleeved over the upper end of the cylindrical portion 39 and engages a circumferential groove 49 in the cylindrical portion 39 to fix the snap ring in place, so as to capture the leg portions of the urging elements 46 between the snap ring 48 and the spring retainer 47. The urging elements are thus substantially prevented from moving axially and radially, and the urging elements are wide enough circumferentially that the ID of the retainer 40 substantially prevents them from moving circumferentially, as can be appreciated from FIGS. 10 and 11.

Thus far, the proximal-end support member 30 has been described in detail. The distal-end support member 50 (FIGS. 1 and 2) comprises an elongate structure having a core-engaging portion 52 configured to engage the interior surface of the core C near the distal end thereof and having a spindle-engaging portion 54 rigidly affixed to the core-engaging portion 52. The spindle-engaging portion 54 defines a bore 56 configured to receive a distal end of the spindle S so as to orient the distal-end support member 54 coaxially with respect to the rotational axis A of the spindle. The core-engaging portion 52 of the distal-end support member 50 in turn locates the distal end of the core coaxially with respect to the rotational axis A. As illustrated, the core-engaging portion 52 can include a radially outwardly extending flange at its top end for abutting the end of the core C when the distal-end support member 50 is properly (fully) inserted into the distal end of the core.

When it is desired to install a paperboard core C on the spindle assembly SA having the proximal-end support member 30 mounted on the hub H in the manner already described, the paperboard core is sleeved down over the proximal-end support member until the lower end of the core abuts the transverse wall 38 (FIG. 1A). This causes the core to compress the core-engaging elements 45 radially inwardly against the force of the urging elements 46, moving the core-engaging elements from the position shown in FIG. 8 to the position shown in FIGS. 9-11. Next, the distal-end support member 50 is inserted into the distal end of the core so as to engage the spindle S as described above. The core is now ready for a yarn-winding operation. The end of a yarn is wound about the core by hand or other means for a sufficient number of turns, or is otherwise secured to the core, so that the yarn is prevented from slipping as the spindle assembly starts to rotate the core about the axis A, and the spindle assembly is accelerated to full speed to wind a yarn package about the core.

Figure 11:
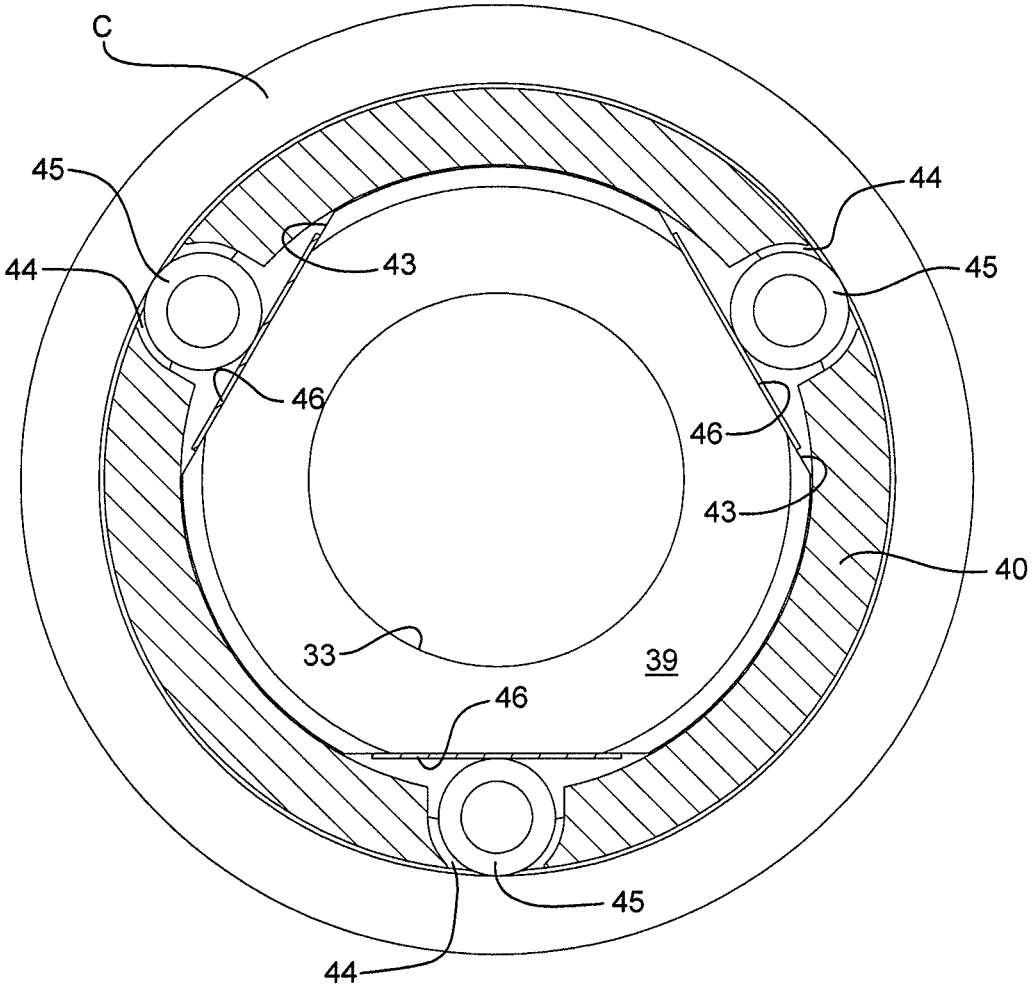
FIG. 11 is an enlarged version of FIG. 10.

The proximal-end support member 30 operates in the following manner to substantially prevent slippage between the support member 30 and the core C. With reference particularly to FIGS. 10 and 11, it will be noted that any relative rotation of the core C with respect to the support member 30 will tend to cause the core-engaging elements 45 to move circumferentially along the urging elements 46 on the wedge surfaces 43. As noted, the retainer 40 is able to rotate relative to the base 32 to allow such movement of the core-engaging elements 45. It will further be noted that the core-engaging elements have a "neutral" position (shown in FIGS. 10 and 11) in which they are at their smallest possible radial distance from the rotational axis of the spindle assembly. Any circumferential movement of the core-engaging elements has the effect of moving them farther away from the rotational axis, and causes them to become wedged between the cylindrical portion 39 of the base 32 and the ID of the core C, which increases the "bite" of the core-engaging elements into the core ID. Thus, the support member 30 has an automatic slip-prevention function. Moreover, this slip-prevention works in either rotation direction, and thus works to prevent slippage both in acceleration and deceleration or braking of the core.

Once a yarn-winding operation is completed to produce a yarn package on the core C, the spindle is brought to rest and the yarn package is removed from the spindle by grasping the yarn package and pulling straight upward to disengage the core from the proximal-end support member 30 and distal-end support member 50. The proximal-end support member remains attached to the hub of the spindle assembly, but the distal-end support member remains engaged in the core. The user can then grasp the distal-end support member 50 and pull it out of the core. The yarn package is then ready to be transported to a further location for processing.

As best seen in FIG. 1, the core-engaging portion 52 of the distal-end support member can define an axial passage through it, connecting with the axial through-passage 56 of the spindle-engaging portion 54. The passage in the core-engaging portion can facilitate the insertion of a finger to aid in removing the distal-end support member from the core C. The passage can have interior surface grooves or ridges as shown in FIG. 1, to increase the friction between the user's finger and the interior surface.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A yarn core assembly, comprising:

a hollow cylindrical paperboard core having an interior surface and an exterior surface, the exterior surface being adapted to have yarn wound thereon to form a yarn package on the core, the core having a proximal end and an opposite distal end; and a proximal-end support member inserted into the proximal end of the core, the proximal-end support member comprising a clutch mechanism operable to automatically prevent or reduce rotational slippage of the core relative to the proximal-end support member, the proximal-end support member having interior surfaces for engagement with drive surfaces of a spindle assembly on which the proximal-end support member is configured to be mounted, wherein the proximal-end support member includes a plurality of wedge surfaces and a plurality of corresponding core-engaging elements, and wherein each wedge surface is configured to move the corresponding core-engaging element farther away from a rotational axis of the spindle assembly upon rotation of the support member, thus providing the clutch mechanism, and wherein proximal-end support further includes a plurality of urging elements, each associated with a corresponding core-engaging element, and wherein each urging element is configured to bias the corresponding core-engaging element radially outward into a canted orientation wherein the lower part of the core-engaging element extends farthest in the radially outward direction.

2. The yarn core assembly of claim 1, further comprising a distal-end support member inserted into the distal end of the core, the distal-end support member defining a bore for receiving a spindle of the spindle assembly.

3. The yarn core assembly of claim 1, wherein the core engaging elements are arranged to be radially movable to a limited radial extent and circumferentially movable to a limited circumferential extent.

4. The yarn core assembly of claim 3, wherein the proximal-end support member is structured and arranged such that circumferential movement of the core-engaging elements causes corresponding radial movement of the core-engaging elements and consequent wedging of the core-engaging elements between the interior surface of the core and opposing surfaces defined by the proximal-end support member.

* * * * *

UNITED STATES PATENT AND TRADEMARK OFFICE

CERTIFICATE OF CORRECTION

PATENT NO. : 9,073,729 B2
APPLICATION NO. : 13/368865
DATED : July 7, 2015
INVENTOR(S) : Hernandez et al.

It is certified that error appears in the above-identified patent and that said Letters Patent is hereby corrected as shown below:

In the claims:

Column 7,
Lines 16 and 17, "wherein proximal-end support" should read --wherein the proximal-end support--.

Signed and Sealed this
Twelfth Day of July, 2016

Michelle K. Lee

Michelle K. Lee
*Director of the United States Patent and Trademark Office*